US010293974B1

(12) United States Patent
Scheer et al.

(10) Patent No.: US 10,293,974 B1
(45) Date of Patent: May 21, 2019

(54) AIRCRAFT ULD INTERFACE ADAPTER

(71) Applicant: GOODRICH CORPORATION, Charlotte, NC (US)

(72) Inventors: Dustin Paul Scheer, Jamestown, ND (US); Wesley K. Stegmiller, Jamestown, ND (US); Aaron J. Roberts, Jamestown, ND (US); Wallace Harold Larson, Jamestown, ND (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/894,403

(22) Filed: Feb. 12, 2018

(51) Int. Cl.
*B65D 19/38* (2006.01)

(52) U.S. Cl.
CPC .... *B65D 19/38* (2013.01); *B65D 2519/00567* (2013.01); *B65D 2519/00761* (2013.01)

(58) Field of Classification Search
CPC ..... B65D 2519/00766; B65D 2519/00761
USPC ..... 108/51.11, 69, 54.1, 55.5, 53.5; 248/346.02; 244/137.1
See application file for complete search history.

(56) References Cited

U.S. PATENT DOCUMENTS 3,129,472 A * 4/1964 Hensel ..... F16B 12/22 29/453
3,478,995 A * 11/1969 Lautzenhiser ..... B61D 45/001 108/55.5
3,591,121 A * 7/1971 Parris ..... B65D 19/0002 108/55.1
3,622,114 A * 11/1971 McIntire, Jr. ..... B65D 19/0002 108/55.5
3,651,769 A 3/1972 Foley
3,698,677 A * 10/1972 Looker ..... B60P 7/0815 108/55.5
3,753,407 A * 8/1973 Tilseth ..... B65D 19/44 108/53.3
4,046,347 A 9/1977 Bryan
4,062,301 A * 12/1977 Pitchford ..... B23P 19/041 108/54.1
4,158,335 A * 6/1979 Belcastro ..... A47B 87/002 108/64
4,629,379 A 12/1986 Harris et al.
5,105,746 A * 4/1992 Reynolds ..... B65D 19/0012 108/54.1
5,284,098 A * 2/1994 Klapperich ..... B65D 19/0002 108/55.5
5,706,738 A * 1/1998 Rapeli ..... B63B 25/22 108/54.1
6,729,091 B1 * 5/2004 Martensson ..... E04F 15/04 446/112
7,118,314 B2 10/2006 Zhou et al.
7,252,468 B2 8/2007 Moore et al.
7,854,204 B2 * 12/2010 Dacus ..... B29C 70/088 108/51.3

(Continued)

FOREIGN PATENT DOCUMENTS

DE 102010024330 12/2011

*Primary Examiner* — Jose V Chen
(74) *Attorney, Agent, or Firm* — Snell & Wilmer, L.L.P.

(57) ABSTRACT

The present disclosure relates to an apparatus to be used in a system that adapts a pallet to cargo handling system. This includes the use of adaptor panels to alter the length of the pallet so that it may conform to a standard pallet length. The present disclosure also relates to a method of use for the adaptor system in applying it to a pallet.

11 Claims, 9 Drawing Sheets

(56) References Cited

U.S. PATENT DOCUMENTS

| | | | | |
|---|---|---|---|---|
| 8,690,103 | B2 | 4/2014 | Schulze et al. | |
| 8,776,698 | B2 * | 7/2014 | Pherson | B65D 19/0002 108/51.3 |
| 9,032,685 | B2 * | 5/2015 | Martensson | E04B 1/6129 52/591.1 |
| 9,051,079 | B2 * | 6/2015 | Kuo | B65D 19/0002 |
| 9,102,437 | B2 * | 8/2015 | Frankenberg | B62B 5/0093 |
| 10,094,402 | B2 * | 10/2018 | Scapin | A47B 77/022 |
| 2009/0116925 | A1 * | 5/2009 | Juchniewicz | B65D 19/0002 410/52 |

* cited by examiner

AIRCRAFT ULD INTERFACE ADAPTER

FIELD

The subject matter disclosed herein relates to cargo transportation systems, and, in particular, to the interface between a cargo pallet, or unit load device ("ULD") and a cargo handling system.

BACKGROUND

Commercial operators that are a part of the Civil Reserve Air Fleet (CRAF) program should be able to load, secure and transport military cargo. Military containers and pallets do not readily interface with commercial cargo handling systems because they generally have different standard sizes and a different edge shape. Commercial operators are generally forced to add complexity at the cost of additional weight to their existing cargo handling systems to accommodate the military ULDs.

SUMMARY

The present disclosure relates to an adaptor which allows a pallet or ULD to interface with a cargo handling system. According to various embodiments, the adaptor may comprise an adaptor panel. The adaptor panel may have a width, height and length. The adaptor panel may also comprise an adaptor panel interface. The adaptor panel interface may comprise a lateral face that is displaced along the width and height of the adaptor panel. The adaptor panel interface may also comprise a protrusion that extends substantially normal from the lateral face, wherein substantially normal is within 10 degrees of perpendicular to the surface of the lateral face. The adaptor panel interface may also comprise a locking mechanism that is partially disposed within the protrusion.

In various embodiments, the lateral face may comprise a recess. The recess may comprise a concave depression in the lateral face of the adaptor panel interface. The protrusion of the adaptor panel interface may comprise housing. The housing may have a first surface with an edge that runs across the lateral surface. A first aperture may be displayed on the first surface of the housing.

In various embodiments, the locking mechanism may comprise a pin located within the housing of the protrusion. The pin may extend out from the housing through the first aperture. The pin may retract into the protrusion through the first aperture.

According to various embodiments, a system is described herein. The system may comprise a first adaptor panel, a unit load device, and a second adaptor panel. The first adaptor panel may have a width, a height, a length. The first adaptor panel may additionally comprise a first adaptor panel interface. The first adaptor panel interface may comprise a lateral face that is disposed along the width and the height of the first adaptor panel.

In various embodiments the first adaptor panel interface may additionally comprise a protrusion extending substantially normal from the lateral face. Substantially normal as used in this instance may be within 10 degrees of perpendicular to the lateral face. The adaptor panel interface may additionally comprise a locking mechanism. The locking mechanism may be partially disposed within the protrusion.

The ULD may comprise a cargo surface, a lateral perimeter surface, and a bottom surface that is opposite the cargo surface.

The system may comprise a second adaptor panel, a unit load device, and a second adaptor panel. The second adaptor panel may have a width, a height, a length. The second adaptor panel may additionally comprise a second adaptor panel interface. The second adaptor panel interface may comprise a lateral face that is disposed along the width and the height of the second adaptor panel. The second adaptor panel interface may additionally comprise a protrusion extending substantially normal from the lateral face. Substantially normal as used in this instance may be within 10 degrees of perpendicular to the lateral face. The adaptor panel interface may additionally comprise a locking mechanism. The locking mechanism may be partially disposed within the protrusion.

According to various embodiments, the first adaptor panel interface may contact the lateral perimeter surface along a width of the cargo surface. The second adaptor panel interface may contact the lateral perimeter surface along a width of the cargo surface that is opposite the width that the first adaptor panel interface contacts.

In various embodiments the length of the first adaptor panel surface may be different from the length of the second adaptor panel. The lateral face of the first adaptor panel may comprise a recess. The ULD may further comprise a tie-down ring. The tie-down ring may be partially contiguous with the lateral perimeter surface. The recess may be aligned with the tie-down ring. The recess may allow access to or use of the tie-down ring.

In various embodiments, the ULD may further comprise an extrusion that extends from the lateral perimeter surface. The extrusion may comprise a frame, wherein a lateral surface of the extrusion is defined by the frame and the lateral perimeter surface. The extrusion may further comprise a base. The base may be substantially perpendicular to the lateral perimeter surface. The base may be substantially perpendicular to the lateral surface of the frame. Here substantially perpendicular may mean within 10 degrees of perpendicular. The extrusion may further comprise an extrusion aperture. The extrusion aperture may be located on the base of the extrusion.

According to various embodiments, the protrusion of the first adaptor panel interface may comprise a housing. The housing may comprise a first face. The first face may be parallel to the base of the extrusion. The protrusion may further comprise a first aperture. The first aperture may be on the first face of the housing.

The locking mechanism of the first adaptor panel interface may comprise a pin. The pin may be located at least partially within the housing. The pin may extend out from the housing, through the first housing aperture and into the extrusion through the extrusion aperture.

According to some embodiments the extrusion may contact the lateral face of the first adaptor panel interface. The protrusion may contact the lateral perimeter surface of the ULD.

A process is additionally described herein. In various embodiments the process comprises attaching a ULD to a first adaptor panel. The process may further comprise attaching the ULD to a second adaptor panel. The ULD may comprise a cargo surface, a lateral perimeter surface, and a bottom surface opposite the cargo surface. The first adaptor panel may have a width, a height, and a length. The first adaptor panel may further comprise an adaptor panel interface. The adaptor panel interface may comprise a lateral face disposed along the width and the height of the first adaptor panel; a protrusion extending substantially normal from the lateral face; and a locking mechanism partially disposed within the protrusion.

In various embodiments the second adaptor panel may have a width, a height, and a length. The second adaptor panel may further comprise an adaptor panel interface. The adaptor panel interface may comprise a lateral face disposed along the width and the height of the second adaptor panel; a protrusion extending substantially normal from the lateral face; and a locking mechanism partially disposed within the protrusion. The first adaptor panel interface and the second adaptor panel interface may contact the lateral perimeter surface along opposite widths of the cargo surface. The ULD may further comprise a tie-down ring that is partially contiguous with the lateral perimeter surface. The first adaptor interface further comprises a recess. Attaching the ULD to the first adaptor panel may comprise aligning the recess of the first adaptor panel to face the tie-down ring of the ULD.

In various embodiments, the protrusion of the first adaptor panel may comprise a housing, a first aperture on a first surface of the housing that has an edge across lateral face. The ULD may further comprise an extrusion extending from the lateral perimeter surface. The extrusion may comprise a frame. The frame and the lateral perimeter surface may define the lateral surface of the extrusion. The extrusion may further comprise a base, wherein the base may be perpendicular to the lateral perimeter surface and the frame. The extrusion may also comprise an extrusion aperture located on the base. In various embodiments, attaching the ULD to the first adaptor may further comprise placing the first adaptor panel interface proximate the lateral perimeter surface of the ULD, along a width of the ULD, placing first face of the housing along the base of the extrusion, and aligning the first housing aperture with the extrusion aperture.

In various embodiments attaching the first adaptor panel to ULD may further comprise engaging the locking mechanism, wherein the locking mechanism may comprise a pin located within the housing and oriented to extend out of the housing through the first aperture. In various embodiments locking the pin into an extended position may comprise translating the pin parallel to the width of the ULD, and extending the pin out of the housing through the first housing aperture and into the extrusion through the extrusion aperture.

In various embodiments, locking the pin in an extended position may comprise translating the pin parallel to the width of the ULD, and extending the pin out of the housing through the first housing aperture and into the extrusion through the extrusion aperture.

In various embodiments the ULD may additionally comprise a tie-down ring. The process disclosed may further comprise engaging the tie-down ring before attaching the first adaptor panel. In various embodiments, the process may further comprise engaging the tie-down rings after attaching the second adaptor panel. In various embodiments the tie-down rings are not engaged.

BRIEF DESCRIPTION OF THE DRAWINGS

The present disclosure may be better understood with reference to the following drawing figures and description. Non-exhaustive and non-limiting descriptions may refer to the following drawings. The components in the figures are not necessarily to scale as the illustrated principles are emphasized therein. Like numbers in the figures may refer to like parts throughout the different figures unless specified otherwise. Comparisons between an embodiment of the invention and a standard pallet are shown in some of the figures.

DETAILED DESCRIPTION

Figure 1A:
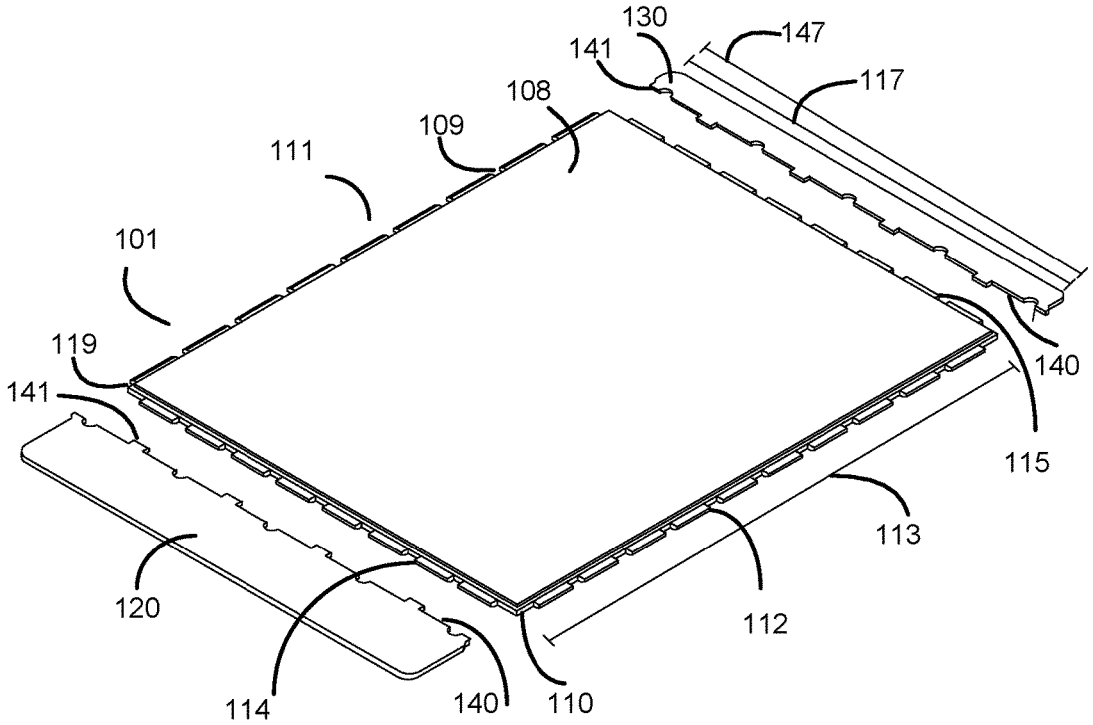
FIG. 1A depicts adaptor panels and the pallet (ULD) separated for the purposes of showing some of the features of each, in accordance with various embodiments.

The detailed description of various embodiments herein refers to the aforementioned drawing figures. These figures and drawings show various embodiments and implementations of the description for purposes of illustration and its best mode, not of limitation. It should be understood that while these embodiments are described in sufficient detail to enable those skilled in the art to practice the embodiments, other embodiments may be realized and that logical and mechanical changes may be made without departing from the spirit and scope of the disclosure. Any reference to singular includes plural embodiments. Any reference to more than one component or step may include a singular embodiment or step. In particular, references to an adaptor panel should be interpreted to apply to both or either the first adaptor panel and the second adaptor panel.

Also, any reference to attached, fixed, connected or the like may include permanent, removable, temporary, partial, full and/or any other possible attachment option. Additionally, any reference to without contact (or similar phrases) may also include reduced contact or minimal contact. Finally, though the various embodiments discussed herein may be carried out in the context of an aircraft, it should be understood that systems and methods disclosed herein may be incorporated into anything incorporating handling cargo, be it aircraft, motor vehicles, trains, ships or other means of transportation of cargo or the handling of cargo as it is placed therein.

Cargo loading and securing systems may be specifically configured to accommodate cargo that has been secured to pallets of a given size. This can be seen in both military and commercial cargo systems. For example, a military 463L cargo system is optimally equipped to load and secure 463L military pallets. When commercial cargo carriers contract to carry military cargo, they must accommodate the standard military pallets that the cargo is loaded on with their existing commercial cargo systems.

In various embodiments, an adaptor can be attached to the military pallet so that the pallet (or ULD) can conform to the commercial carriers existing cargo system. In various embodiments the 436L military ULD may be the same width as a standard NAS3610 size A commercial pallet. The cargo system may be configured to load and secure the size A pallet. The military 436L ULD has a narrower length than the commercial size A pallet. An adaptor can alter the effective length of the military ULD by attaching to an end such that the resulting ULD-adaptor combination has the same length as the size A commercial pallet. The width of the ULD may be left unaltered so it does not occupy additional space in the cargo hold.

The length can be altered by attaching two adaptor panels to opposite sides of the military pallet. When the two adaptor panels have different lengths the location of the military pallet can be moved off center from the resulting adapted pallet. In various embodiments, this allows for the restraints of the cargo system to interact with surfaces of the military ULD that are equivalent to surfaces of a commercial pallet without further altering the ULD, and adding additional weight.

According to various embodiments and with reference to FIG. 1A, the ULD 101 comprises a cargo face 108, a lateral perimeter surface 110, and a bottom surface 109 opposite the cargo face 108. The cargo face 108 is the side of the ULD upon which the cargo rests. The lateral perimeter surface 110 comprises the sides 114 and 115 that run along the width 117 of the pallet, and sides 111 and 112 that run along the length 113 of the pallet, around the cargo face 108. The lateral perimeter surface additionally extends along the height 119 of the ULD 101.

According to various embodiments, the adaptor has a first panel adaptor 120 and a second panel adaptor 130. Each of the panel adaptors has a lateral face 140 and a protrusion 141 extending substantially normal from the lateral face 140. Herein, substantially normal means within 10 degrees of a right angle. The lateral face 140 extends the along at least a portion of the width 147 of the first adaptor panel 120 and along at least a portion of the height 119 of the first adaptor panel 120. In various embodiments, the width 147 of the adaptor panel 120 or 130 is equal to the width 117 of the ULD 101. In various embodiments the width 147 of the adaptor panel 120 or 130 is less than or greater than the width 117 of the ULD 101.

Figure 1B:
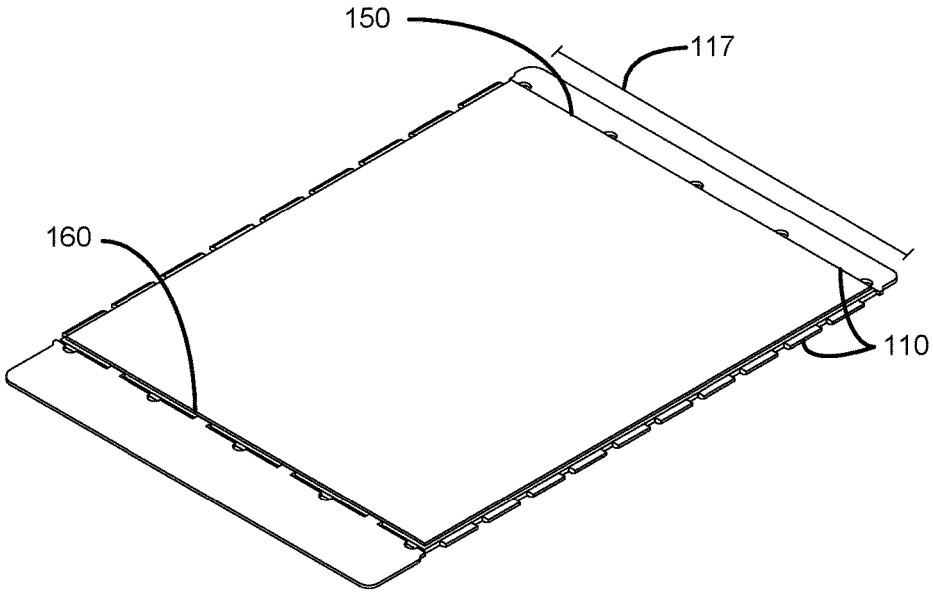
FIG. 1B depicts adaptors and ULD when attached, in accordance with various embodiments.

As shown in FIG. 1B, in various embodiments the first adaptor panel 120 connects to or contacts the lateral perimeter surface 110 of the ULD along a width 160 of the ULD. The second panel adaptor 130 connects to or contacts the lateral perimeter surface 110 along the opposite width 150 of the ULD 101. The addition of the adaptors to the ULD thereby extends the length of the ULD 101.

Figure 2:
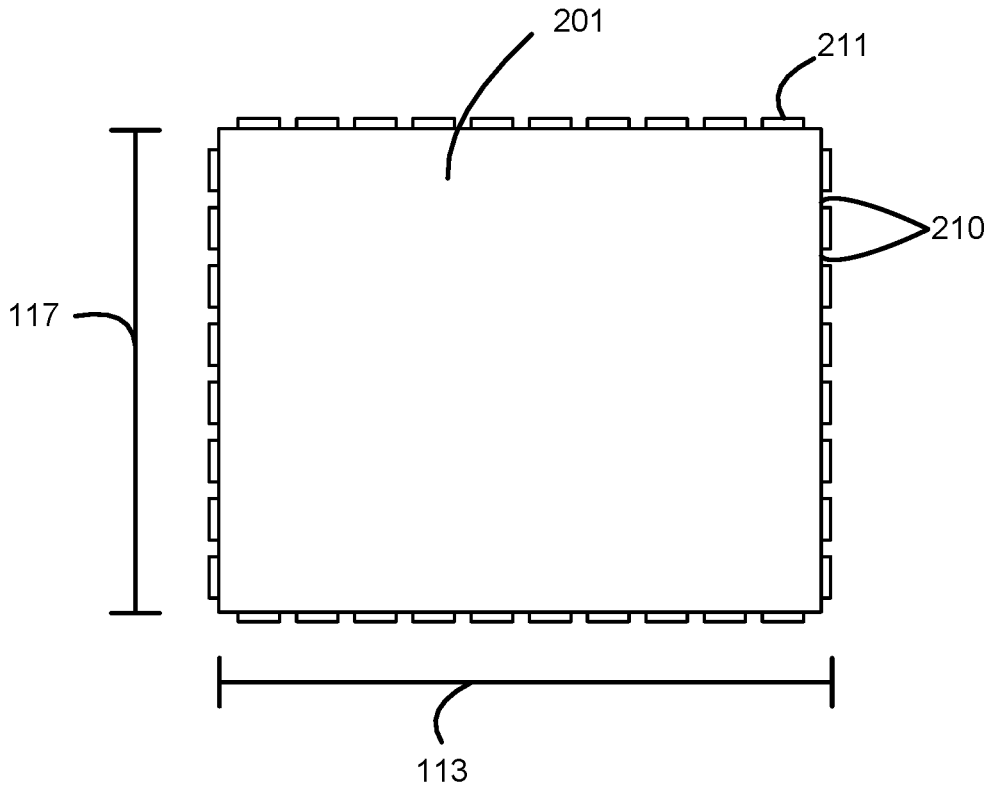
FIG. 2 illustrates the cargo surface of the ULD as viewed from above and the extrusions that extend outward from the ULD, in accordance with various embodiments.

With reference to FIG. 2, ULD 201 additionally comprises a lateral perimeter surface 210. In various embodiments, the ULD 201 also comprises one or more extrusions 211. The extrusions extend outward from the lateral perimeter surface 210 of the ULD.

Figure 3A:
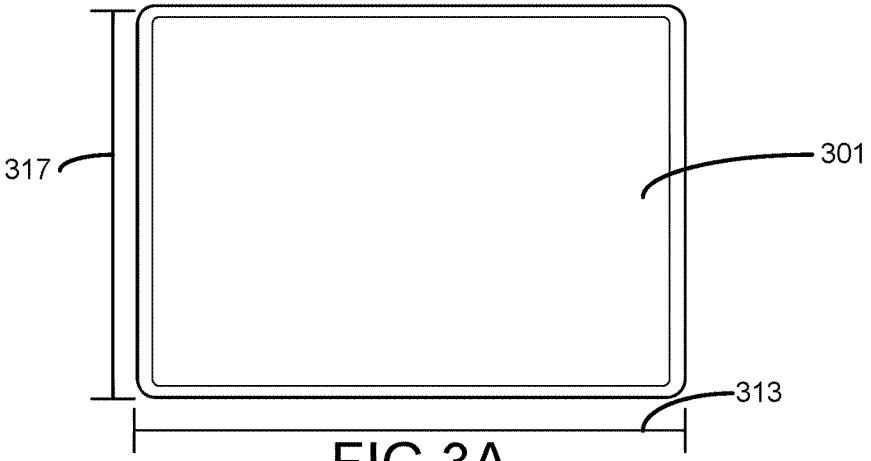
FIG. 3A is a depiction of a standard commercial pallet, in accordance with various embodiments.
Figure 3B:
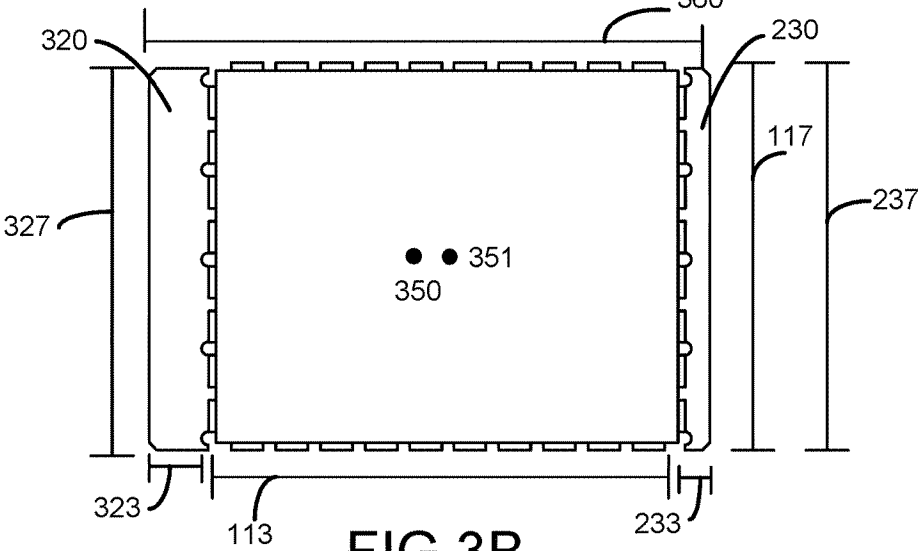
FIG. 3B is a depiction of pallet, intended in part for comparison to the commercial pallet depicted in FIG. 3A, in accordance with various embodiments.

FIG. 3A shows a standard commercial pallet 301 with a length 313 and a width 317. The standard pallet may be a size A standard pallet with a length of 125 inches (317.5 centimeters) and width of 88 inches (223.52 centimeters). With reference to FIG. 3B, the ULD has a length 113 and a width 117. The first adaptor panel has a length 323 and a width 327, and the second adaptor panel also has a length 233 and a width 237. The width 117 of the ULD may be equal, less than, or greater than the width 327 of the first adaptor panel. The width 327 of the first adaptor panel may be equal to, less than, or greater than the width 237 of the second adaptor panel. That is the width of each of the adaptor panels and the ULD may be between about 60 and about 125 inches (152.4-317.5 centimeters), between about 70 and 110 inches (177.8-279.4 centimeters), and between about 80 and about 90 inches (203.2-228.6 centimeters) wherein about in only this context means+/−3 inches (+/−7.62 centimeters).

The length 323 of the first adaptor 320 panel may be greater than the length 233 of the second adaptor panel 230. This allows the center of the ULD 351 to be translated away from the center of the combined adaptor panels and ULD 350. When the ULD is secured within the aircraft, the cargo system may interface with a portion of the ULD that is similar to a commercial ULD. By translating the ULD, an appropriate surface of the ULD can be used. This also allows for aircraft specific tailoring by utilizing a first adaptor 320 and a second adaptor panel 230 with different ratios along their lengths. In response to the first adaptor 320 and the second adaptor panel 230 being attached to the ULD, the combined length 360 is equal to that of a standard commercial pallet. In some embodiments, this combined length may be between about 60 and about 125 inches (152.4-317.5 centimeters), between about 80 and about 140 inches (203.2-355.6 centimeters), or between about 100 and about 130 inches (254-330.2 centimeters), wherein about in only this context means+/−10 inches (+/−25.4 centimeters).

Figure 4:
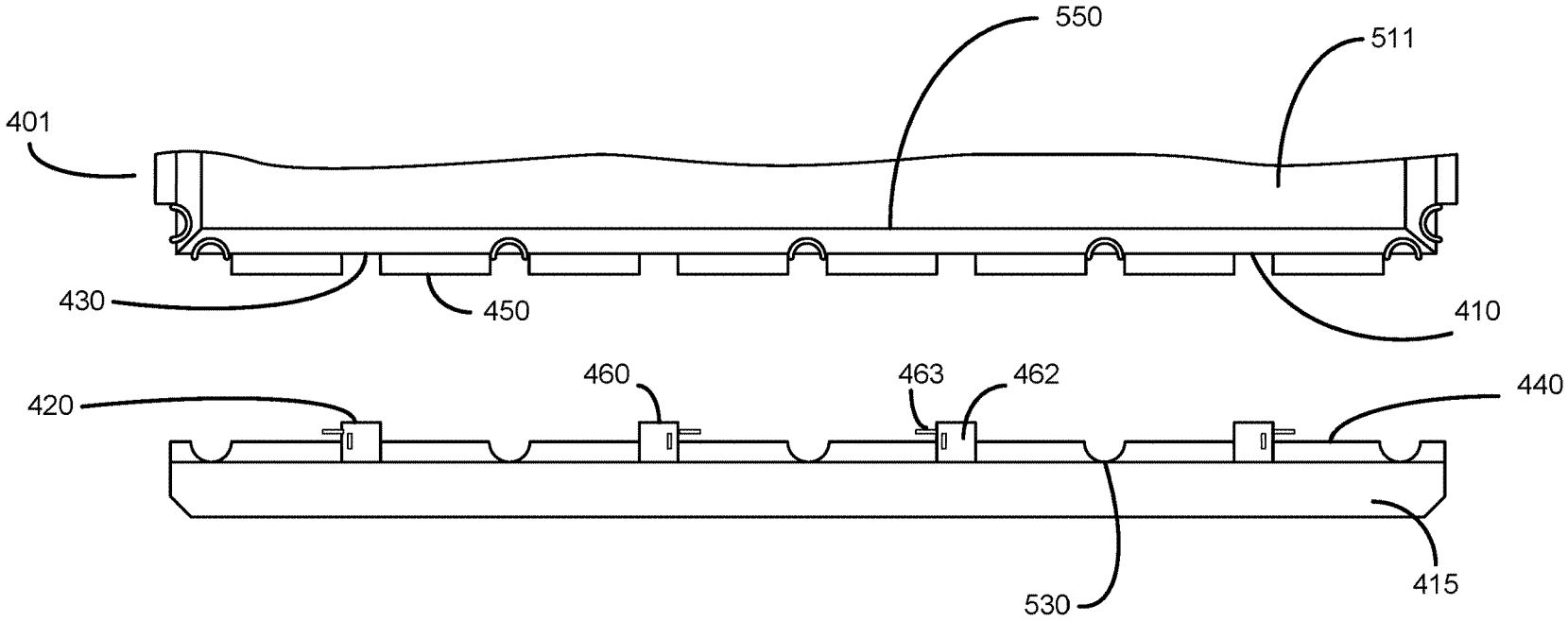
FIG. 4 depicts a more detailed view of the interface of the ULD and an adaptor panel, in accordance with various embodiments.

Turning to FIG. 4, in various embodiments the lateral face 440 of the adaptor panel 415 is parallel to the lateral perimeter surface 410 of the ULD 401. One or more protrusions 420 may align with a space 430 adjacent to an extrusion 450, or a space 430 between extrusions.

Figure 5:
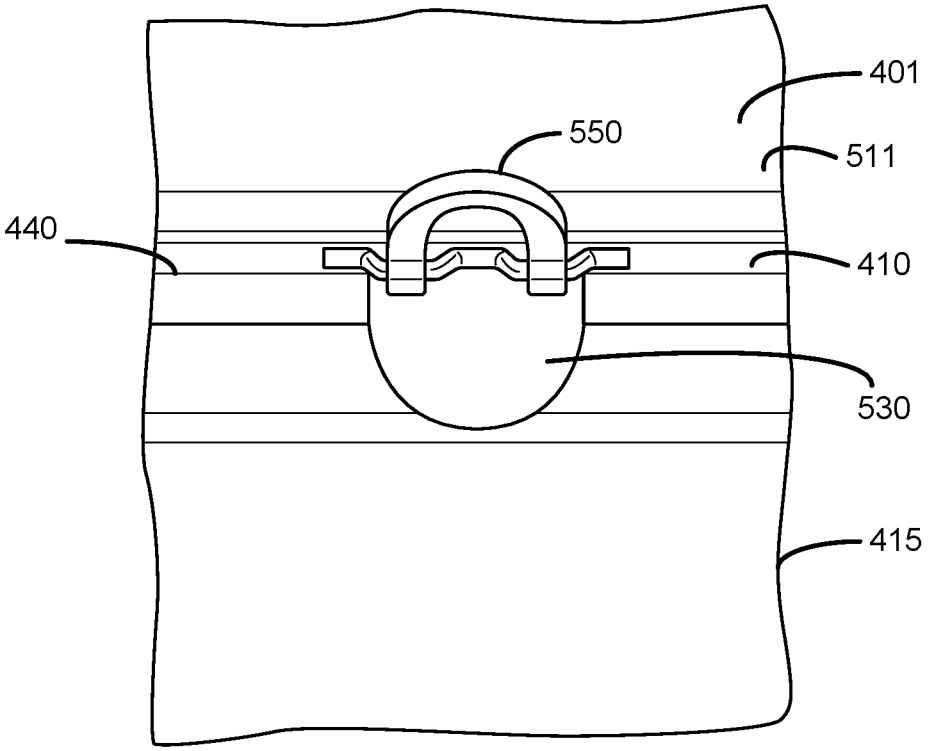
FIG. 5 illustrates the relation between a recess on the adaptor pallet and a tie-down ring on the ULD, in accordance with various embodiments.

The ULD may also comprise one or more tie-down rings 550, as seen in FIGS. 4 and 5. The tie-down rings 550 may be partially contiguous with the lateral perimeter surface 410 of the ULD 401. The tie-down rings 550 may be engaged to restrain cargo on the cargo face 511 of the ULD. The lateral face 440 of the adaptor panel 415 may further comprise a recess 530. The recess 530 may form a portion of a cylinder, which extends up the height of the adaptor panel. The recess 530 may have some other geometry, such as a rectangular or triangular prism. The location of the recess 530 along the width of the adaptor panel 415 may correspond to the location of a tie-down ring 550 on the ULD, so as to allow access to and use of the tie-down rings 550. The tie-down rings 550 can therefore be engaged before or after the adaptor panel 415 is attached to the ULD. There may be more recesses 530 than tie-down rings 550, or more tie-down rings 550 than recesses 530.

There may additionally be a locking mechanism to affix the adaptor panels to the ULD. The type of locking mechanism used to affix the first adaptor panel to the ULD may be any mechanism suitable for coupling an adaptor panel to the ULD.

In various embodiments, the locking mechanism 460 may be at least partially located within or on a protrusion. The locking mechanism may comprise a pin 463. In some embodiments the pin 463 is housed within the protrusion 420. In some embodiments the pin 463 may be fully removable from the protrusion 420, and only placed within the protrusion 420 when the panel 415 is to be affixed to another structure. More than one locking mechanism 460 may be located on a given protrusion 420, and more than one protrusion 420 may have a locking mechanism 460. In an embodiment where one locking mechanism 460 per protrusion 420 is used, the pins 463 may extend from their respective protrusions in alternating directions. In various embodiments the pins 463 may all extend in a single direction. There may be fewer locking mechanisms 460 than there are protrusions 420.

Figure 6:
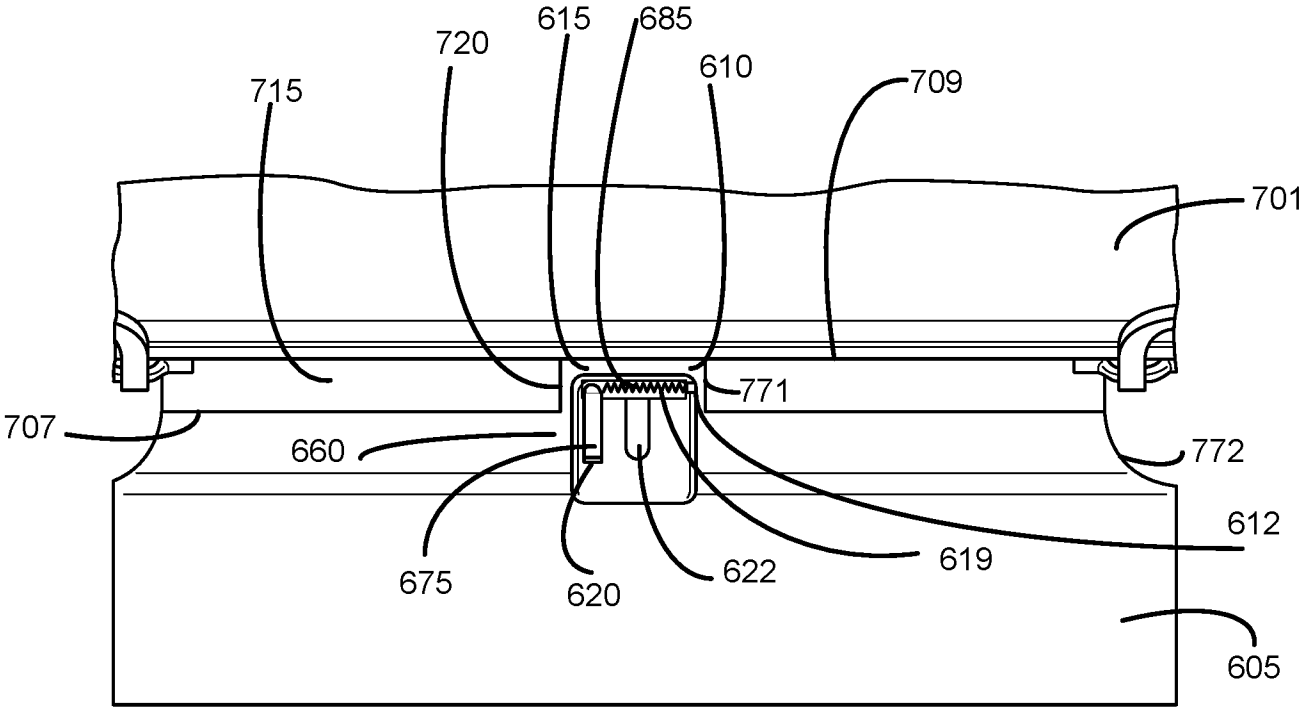
FIG. 6 illustrates a an embodiment of the locking mechanism and interface between an adaptor panel and a ULD, in accordance with various embodiments.
Figure 7:
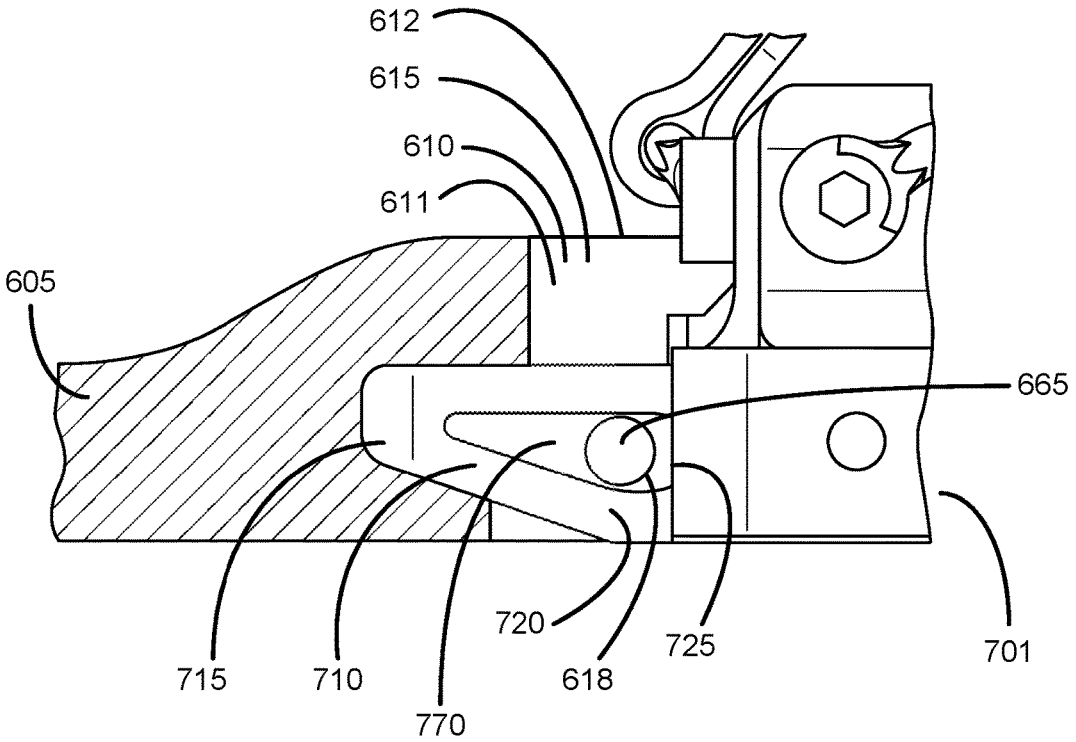
FIG. 7 depicts a cross sectional view of the interface of the locking mechanism and ULD, in accordance with various embodiments.

Turning to FIGS. 6 and 7, the protrusion 610 may comprise a housing 615. The housing 615 may comprise a first face 611 and a second face 612. The first face may 611 have a first housing aperture 618.

In various embodiments, a locking mechanism 660 located on or within the protrusion 610. Wherein the locking mechanism comprises a pin 665, the pin 665 may be located within the housing 615 and can move or translate along at least a portion of the width of the adaptor panel 605 through the first housing aperture 618.

In various embodiments the locking mechanism may include a means for locking the pin 665 into a position, which may be fully retracted within the protrusion, fully extended, or a position in between those extremes. The pin 665 may be moved and locked into position using a mechanism, including but not limited to, a dead bolt, latch bolt, draw latch, button lock, a hitchpin clip, or affixing a nut to the pin, wherein the pin 665 may comprise a bolt.

In various embodiments locking mechanism may be similar to a barrel bolt. The mechanism used to move and lock the pin 665 into place may be a tab 675. The locking mechanism may additionally comprise a spring 685. The second face 612 of the housing may have a second housing aperture 619. The second housing aperture 619 may comprise a racetrack and be perpendicular to a first indentation 620 and a second indentation 622. The tab 675 connects to the pin 665 through the second aperture 619. The pin 665 can be translated using the tab 675. In various embodiments, the tab 675 can be rotated downward into the first indentation 620 to lock the pin 665 in an extended position or in the second indentation 622 to lock the pin 665 in an extended position. A spring 685 can also optionally be disposed within the second aperture 619 to allow the pin 665 to be more easily extended or retracted.

The extrusion 710 of the ULD 701, as seen in FIG. 7 may comprise a frame 715 and a base 720. The frame 715 may extend outward from the lateral perimeter surface 725. The frame 715 and the lateral perimeter surface 725 of the ULD form the lateral surface of the extrusion. The base 720 of the extrusion 710 may be substantially perpendicular to the frame 715, where substantially perpendicular means within 15 degrees of a right angle. The base 720 comprises an extrusion aperture 770. The extrusion aperture 770 may extend from one side 771 of the extrusion to the other 772, along the width of the ULD.

When locking mechanism 660 is engaged and the pin 665 is extended out from the first housing aperture 618, it may extend into the extrusion aperture 770, thus limiting the relative movement of the adaptor panel 605 and the ULD 701. The pin 665 may comprise a cylindrical shape. It may comprise a different shape so long as it can be extended into the extrusion aperture 770.

In various embodiments the pin 665 will contact the frame 715 of the extrusion 710 within the extrusion aperture 770. The extrusion 710 will contact the adaptor panel interface 707. The lateral perimeter surface 709 will contact the protrusion 610. The interaction of these elements will prevent or limit movement of the adaptor panel 605 and ULD 701 relative to one another.

Figure 8:
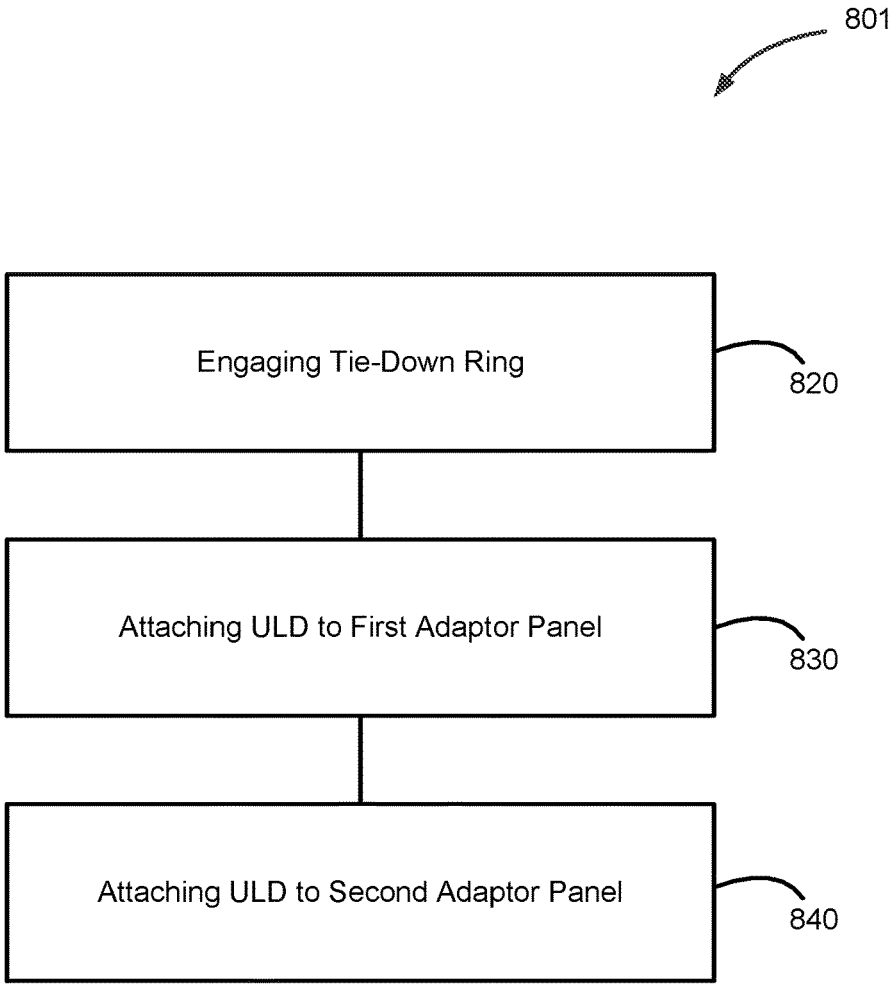
FIG. 8 illustrates a method of attaching the adaptor panels to the ULD, in accordance with various embodiments.

Disclosed herein is also a process related adapting a pallet to interface with a cargo handling system. With reference to FIG. 8, the process 801 may engaging a tie-down ring 820, or a plurality of tie-down rings. This allows the cargo to be secured to the cargo face of the ULD. The process may also comprise attaching the ULD to the first adaptor panel 830, and attaching the second adaptor panel to the ULD 840. In various embodiments the first and second adaptor panels are attached to opposite sides of the ULD along the lateral perimeter surface of the ULD. The adaptor panels attach to the widths of the ULD such that they extend the length of the ULD. The tie-down rings may optionally be engaged at any time during the process. That is, the ULD may be loaded with cargo at the beginning of the process, the end of the process, during the process, or not at all.

Figure 9:
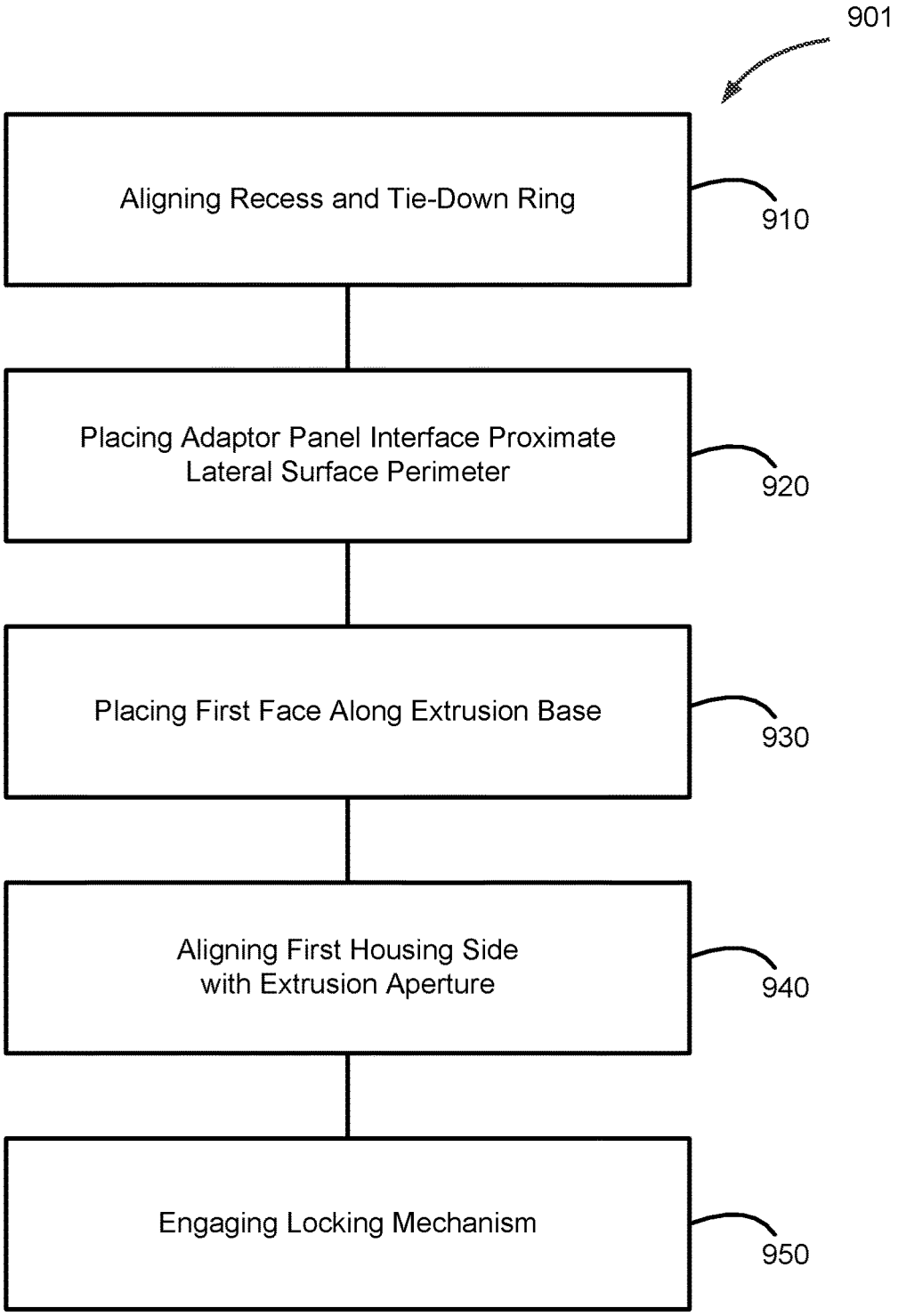
FIG. 9 also illustrates a method of attaching the adaptor panels to the ULD, in accordance with various embodiments

Attaching the ULD and the first adaptor panel and the ULD and the second adaptor panel may comprise the same steps. The following description may be completed to attach the first adaptor panel along the first width of the lateral perimeter surface or the second adaptor panel along the second width of the lateral perimeter surface. With reference to FIG. 9, attaching an adaptor panel and the ULD 901 comprises aligning a recess in the adaptor panel interface with a tie-down ring on the lateral perimeter surface of the ULD 910. This allows for the tie-down ring to be accessed and additionally engaged before or after the ULD and the first adaptor panel are attached. Attaching the ULD to an adaptor panel further comprises placing the adaptor panel interface proximate the lateral perimeter surface 920; placing the first face of the protrusion housing along the base of the extrusion 930; and aligning the first housing side with the extrusion aperture 940. If there is a plurality of protrusions and extrusions, this may also necessitate placing protrusions between extrusions along a width of the ULD. In various embodiments this allows the extrusions to contact the first adaptor panel interface, the protrusions to contact the lateral perimeter surface of the ULD, or both, thereby restraining the movement of the ULD and the first adaptor panel relative to one another. Protrusions and extrusions may also contact one another such as across an extrusion base and a first surface of a protrusion housing thereby further limiting ULD and adaptor panel movement relative to one another.

In various embodiments, attaching the ULD to an adaptor panel may also comprise engaging the locking mechanism 950. In embodiments that the locking mechanism comprises a pin, engaging the locking mechanism may comprise translating the pin so that it extends out from the protrusion housing through the first housing aperture and into the extrusion through the extrusion aperture. The locking mechanism may additionally comprise a means for fixing or locking the pin into a position. In some embodiments, this may be done by means of a tab. In various embodiments, engaging the locking mechanism may comprise translating the tab in the second housing aperture. The tab and pin may be connected such that translating the tab will also extend the pin partially out of the protrusion housing through the first housing aperture and into the extrusion through the extrusion aperture. Once extended, the pin will be partially surrounded by the frame of the extrusion and partially surrounded by the housing of the protrusion. This will further restrict movement of the ULD and the adaptor panel, relative to one another. Engaging the locking mechanism may also include rotating the tab down into a first recess to stop the lateral movement of the tab. As the tab is connected to the pin, the pin will also be locked into an extended position.

Additionally, benefits, other advantages, and solutions to problems have been described herein with regard to various embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, and C" or "at least one of A, B, or C" is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

As used herein, the singular forms "a," "an," and "the" include plural referents unless the context clearly dictates otherwise. As used herein, the terms "for example," "for instance," "such as," or "including" are meant to introduce examples that further clarify more general subject matter. Unless otherwise specified, these examples are embodiments of the present disclosure, and are not meant to be limiting in any fashion.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system comprising:

a first adaptor panel, having a width, a height, a length, and a first adaptor panel interface which comprises a first adaptor panel lateral face disposed along the width and the height of the first adaptor panel, a protrusion extending substantially normal from the lateral face of the first adaptor panel, and a locking mechanism partially disposed within the protrusion of the first adaptor panel;

a unit load device (ULD) comprising a cargo surface, a lateral perimeter surface, a bottom surface opposite the cargo surface, and an extrusion that extends from the lateral perimeter surface, comprising a frame, wherein the frame and the lateral perimeter surface define a lateral surface of the extrusion, a base, wherein the base is perpendicular to the lateral perimeter surface and the frame, and an extrusion aperture located on the base; and a second adaptor panel, having a width, a height, a length, and a second adaptor panel interface which comprises a second adaptor panel lateral face disposed along the width and the height of the second adaptor panel, a protrusion extending substantially normal from the lateral face of the second adaptor panel, and a locking mechanism;

wherein the first adaptor panel interface and the second adaptor panel interface contact the lateral perimeter surface along opposites widths of the cargo surface.

2. The system of claim 1, wherein the lateral face of the first adaptor panel comprises a recess.

3. The system of claim 2, wherein ULD further comprises a tie-down ring that is partially contiguous with the lateral perimeter surface.

4. The system of claim 3, wherein the recess is aligned to face the tie-down ring.

5. The system of claim 1, wherein the protrusion extends toward the ULD from the lateral face and comprises: a housing, a first face of the housing that is parallel to the base of the extrusion, and a first housing aperture on the first face.

6. The system of claim 5, wherein the locking mechanism comprises:

a pin located within the housing that extends through the first housing aperture and into the extrusion aperture.

7. The system of claim 6, wherein the extrusion contacts the lateral face or the protrusion contacts the lateral perimeter surface.

8. A process comprising:

attaching a unit load device (ULD), comprising a cargo surface, and a lateral perimeter surface, to a first adaptor panel, having a width, a height, a length, and a first adaptor panel interface which comprises a lateral face disposed along the width and the height of the first adaptor panel, a first adaptor panel protrusion extending substantially normal from the lateral face, and a locking mechanism; and attaching the ULD to a second adaptor panel, having a width, a height, a length, and a second adaptor panel interface which comprises a lateral face disposed along the width and the height of the second adaptor panel; a second adaptor panel protrusion extending substantially normal from the lateral face, and a locking mechanism partially disposed within the protrusion; wherein the first adaptor panel interface and the second adaptor panel interface contact the lateral perimeter surface along opposites widths of the cargo surface, wherein the ULD further comprises a tie-down ring that is partially contiguous with the lateral perimeter surface, and the first adaptor interface further comprises a recess, where attaching the ULD to the first adaptor panel comprises aligning the recess of the first adaptor panel to face the tie-down ring of the ULD, and wherein the protrusion comprises a housing, a first aperture on a first surface of the housing that has an edge across lateral face, and the ULD further comprises an extrusion extruding from the lateral perimeter surface, comprising a frame, wherein the frame and the lateral perimeter surface define a lateral surface of the extrusion, a base, wherein the base is perpendicular to the lateral perimeter surface and the frame, and an extrusion aperture located on the base; and attaching the ULD to the first adaptor panel further comprises:

placing the first adaptor panel interface proximate the lateral perimeter surface of the ULD, along the width of the ULD;

placing first face of the housing along the base of the extrusion, and aligning the first housing aperture with the extrusion aperture.

9. The process of claim 8, wherein attaching the first adaptor panel to the ULD further comprises engaging the locking mechanism of the first adaptor panel, wherein the locking mechanism comprises a pin located within the housing and oriented to extend out of the housing through the first aperture; comprising translating the pin parallel to the width of the ULD, and extending the pin out of the housing through the first housing aperture and into the extrusion through the extrusion aperture.

10. The process of claim 8, further comprising engaging the tie-down ring before attaching the first adaptor panel.

11. The process of claim 8, further comprises engaging the tie-down rings after attaching the second adaptor panel.

* * * * *